US005294277A

United States Patent [19]

Obata

[11] Patent Number: 5,294,277

[45] Date of Patent: Mar. 15, 1994

[54] THERMAL TRANSFER PRINTING METHOD

[75] Inventor: Yoshiyuki Obata, Osaka, Japan

[73] Assignee: Fujicopian Co. Ltd., Osaka, Japan

[21] Appl. No.: 32,029

[22] Filed: Mar. 16, 1993

[30] Foreign Application Priority Data

Mar. 19, 1992 [JP] Japan ..... 4-63558

[51] Int. Cl.[5] ..... B41M 5/025

[52] U.S. Cl. ..... 156/235; 156/239; 156/240; 428/195; 428/913; 428/914

[58] Field of Search ..... 156/235, 239, 240; 428/195, 913, 914

[56] References Cited

FOREIGN PATENT DOCUMENTS 57-107859A 7/1982 Japan .

2-187367A 7/1990 Japan .

*Primary Examiner*—Pamela R. Schwartz

*Attorney, Agent, or Firm*—Adduci, Mastriani, Schaumberg & Schill

[57] ABSTRACT

A thermal transfer printing method including the steps of: forming first an image on an intermediate transfer drum by heating a meltable-type thermal transfer ink sheet with a thermal head; and transferring the image formed on the intermediate transfer drum onto an image receptor, wherein the meltable-type thermal transfer ink sheet and the image receptor are fed at a velocity $V_1$ and a velocity $V_3$, respectively and the intermediate transfer drum rotates at a peripheral velocity $V_3$, the velocities $V_1$, $V_2$ and $V_3$ satisfying the equations (1), (2) and (3): (1) $N_1=V_2/V_1=1$ to 10, (2) $N_2=V_3/V_2=1$ to 10, and (3) $N_3=V_3/V_1\geqq 2$. With such a method, the amount of ink sheet to be consumed can be substantially reduced, and the printing velocity can be increased, while at the same time a printing device for use in this method can be scaled down.

10 Claims, 4 Drawing Sheets

| | |
|---|---|
| a | $N_3 = 2$ |
| b | $N_3 = 5$ |
| c | $N_3 = 10$ |
| d | $N_3 = 20$ |
| e | $N_3 = 40$ |
| f | $N_3 = 80$ |

THERMAL TRANSFER PRINTING METHOD

BACKGROUND OF THE INVENTION

The present invention relates to a thermal transfer printing method and, in particular, to an indirect thermal transfer printing method.

An indirect thermal transfer printing method of the conventional type is an image formation method wherein a device such as shown in FIG. 1 is used. In FIG. 1, numeral 10 denotes a rotatable intermediate transfer drum of which the surface is formed of an elastic material of good releasing property such as silicone rubber, fluorine-containing rubber or the like. Numeral 11 denotes a recording part which is arranged so that a thermal transfer ink sheet 12 can be pressed against the intermediate transfer drum 10 with a thermal head 13. In printing, the ink sheet 12 is moved in the direction indicated by an arrow as the intermediate transfer drum 10 rotates. Numeral 14 denotes a transfer part which is arranged so that an image receptor 15 can be pressed against the intermediate transfer drum 10 with a pressing roller 16. In transferring, the image receptor 15 is moved in the direction indicated by an arrow.

The thermal head 13 heats the thermal transfer ink sheet 12 so as to selectively soften or melt portions of the ink thereof, which is transferred onto the surface of the intermediate drum 10. While the intermediate drum 10 and the ink sheet 12 are thus moved in the directions indicated by the arrows, respectively, the softened or melted ink is transferred onto the intermediate drum 10 thereby forming an ink image 17 thereon. As the drum 10 rotates, the ink image 17 is moved to the transfer part 14, pressed against the image receptor 15 there, and transferred onto the image receptor 15 to form a final ink image 18 thereon.

According to such an indirect thermal transfer printing method, the ink of the ink sheet which is heated with the thermal head 13 is transferred onto a smooth surface of the intermediate transfer drum 10. Hence, there has been overcome such a problem involved in a common thermal transfer method that unclear transferred images are likely to be formed on a recording sheet of which the surface is poor in smoothness. Further, according to the indirect thermal transfer printing method of the conventional type, ink images on the intermediate transfer drum 10 are transferred onto the image receptor 15 by pressing thereagainst under a relatively large pressure with the pressing roller 16. Hence, the quality of the thus obtained images is not subject so much to the superficial conditions of the image receptor. Therefore, the indirect thermal transfer printing method provides clear images regardless of the type of the image receptor 15.

With this type of indirect thermal transfer printing method, however, there are problems left unsolved such as high cost for consumable items due to a large amount of expensive ink sheet consumed in thermal transfer printing and low printing speed.

It is an object of the present invention to provide an indirect thermal transfer printing method which is capable of effectively utilizing a thermal transfer ink of an ink sheet while improving the printing speed.

This and other objects of the invention will become apparent from the description hereinafter.

SUMMARY OF THE INVENTION

The present invention provides a thermal transfer printing method comprising the steps of: forming first an image on an intermediate transfer drum by heating a meltable-type thermal transfer ink sheet with a thermal head; and transferring the image formed on the intermediate transfer drum onto an image receptor, wherein the meltable-type thermal transfer ink sheet and the image receptor are fed at a velocity $V_1$ and a velocity $V_3$, respectively and the intermediate transfer drum rotates at a peripheral velocity $V_2$, the velocities $V_1$, $V_2$ and $V_3$ satisfying the equations (1), (2) and (3):

$$N_1 = V_2/V_1 = 1 \text{ to } 10 \quad (1)$$

$$N_2 = V_3/V_2 = 1 \text{ to } 10 \quad (2)$$

$$N_3 = V_3/V_1 \geqq 2 \quad (3).$$

DETAILED DESCRIPTION

In the conventional indirect thermal transfer printing method, the feeding velocity $V_1$ of the ink sheet 12 is equal to the feeding velocity of the image receptor 15 ($N_3 = V_3/V_1 = 1$), while in the present invention the feeding velocity $V_3$ of the image receptor 15 is twice or more as high as the feeding velocity $V_1$ of the ink sheet 12 ($N_3 = V_3/V_1 \geqq 2$).

Figure 2:
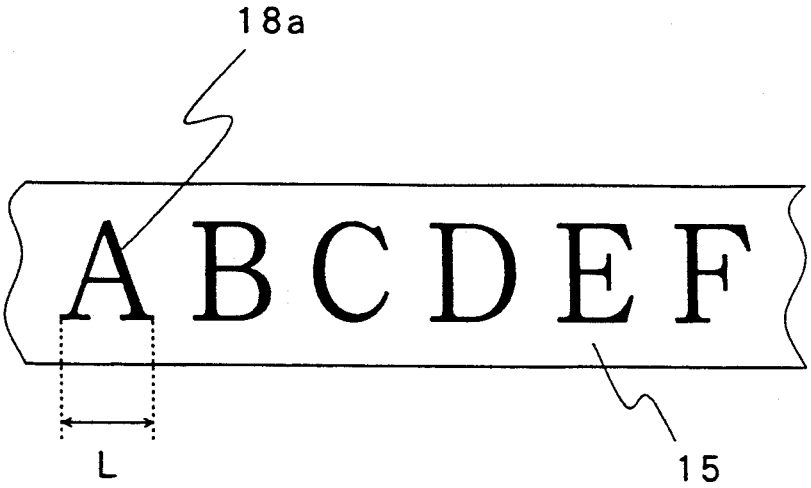
FIG. 2 is a plan view showing images formed on an image receptor according to the present invention.
Figure 3:
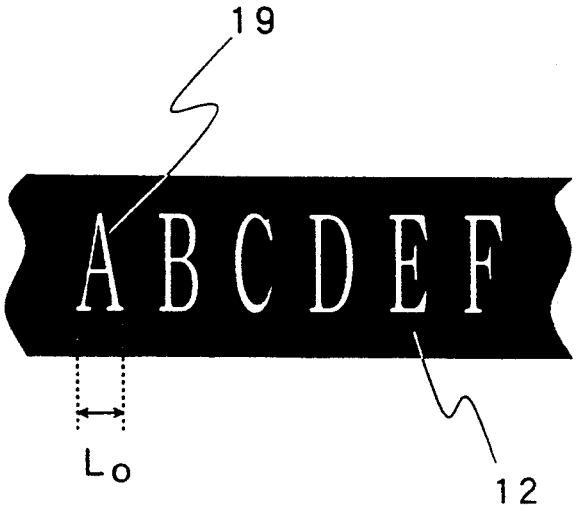
FIG. 3 is a plan view showing an ink sheet having been used in the present invention, from which the ink drawing the images shown in FIG. 2 has come off.

The effect offered by such a relation is to be described with reference to the drawings. It is herein assumed that $N_3 = 2$. FIG. 2 is a plan view showing letter images 18*a* formed on the image receptor 15 according to the indirect thermal transfer printing method of the present invention. FIG. 3 is a plan view showing traces 19 from which the ink of the ink sheet 12 has come off to form the letter images 18*a*. As shown in these drawings, the width of each trace 19 on the ink sheet 12 is half the width of each letter image 18*a* on the image receptor 15. As a matter of course, the line width of each trace 19 in the traveling direction of the ink sheet 12 is half that of each letter image 18*a*. This means that the amount of ink sheet necessary for printing according to the present invention is halved as compared with that according to the conventional method.

Although the above case is described with an assumption of $N_3 = 2$, in general the amount of ink sheet to be used is reduced by a factor of $1/N_3$ (where $N_3 \geqq 2$) as compared with that according to the conventional method.

In the indirect thermal transfer printing method of the present invention, the rate-determining step is the printing step at the recording part 11 wherein the printing speed is $V_1$. If the printing speed in this step is substantially the same as in the conventional method, the printing speed as a whole is $N_3$ (where $N_3 \geqq 2$) times as high as that according to the conventional method since the transfer speed at the transfer part 14 is $N_3$ times as high as that according to the conventional method.

In the case where a color image is formed according to the conventional indirect thermal transfer method by superimposing an yellow image, magenta image and cyan image one one the other on the transfer drum, and transferring the superimposed iamge onto a receptor sheet, the circumference of the transfer drum needs to have at least the length of the receptor sheet. In contrast, when a color image is formed according to the present invention, the circumference of the transfer drum needs only $1/N_2$ times the length of the receptor sheet. Accordingly, the transfer drum can be reduced in size.

Since the method of the present invention is an indirect thermal transfer printing method, as a matter of course, the advantage of obtaining clear images regardless of the type of the image receptor 15 is retained.

Next, the present invention is to be described specifically.

In the present invention, when the velocity ratio $N_3$ is too large, deformed or unclear images are likely to be formed on the image receptor. Accordingly, the velocity ratio $N_3$ is usually 80 or less, preferably 60 or less, more preferably 40 or less, further more preferably 20 or less, most preferably 10 or less. In the indirect thermal transfer printing method according to the present invention, the ink layer of the ink sheet and the intermediate transfer drum, and/or, the image receptor and the intermediate transfer drum are in a relative sliding relation with each other. Accordingly, too large relative velocity between them results in a difficulty of obtaining transferred images of a desired quality. Therefore, it is preferable that the velocity ratios $N_1$ and $N_2$ assume $N_1 \leqq 10$, $N_2 \leqq 10$, respectively.

There are the following three preferred embodiments in the present invention:

EMBODIMENT 1

The peripheral velocity $V_2$ of the intermediate transfer drum is twice to 10 times the feeding velocity $V_1$ of the ink sheet, and the peripheral velocity $V_2$ is equal to the feeding velocity $V_3$ of the image receptor. That is, $N_1 = V_2/V_1 = 2$ to 10, $N_2 = V_3/V_2 = 1$, and $N_3 = V_3/V_1 = 2$ to 10.

EMBODIMENT 2

The feeding velocity $V_1$ of the ink sheet is equal to the peripheral velocity $V_2$ of the intermediate transfer drum, and the feeding velocity $V_3$ of the image receptor is twice to 10 times the peripheral velocity $V_2$. That is, $N_1 = V_2/V_1 = 1$, $N_2 = V_3/V_2 = 2$ to 10, and $N_3 = V_3/V_1 = 2$ to 10.

EMBODIMENT 3

The peripheral velocity $V_2$ of the intermediate transfer drum is 1 to 10 times the feeding velocity $V_1$ of the ink sheet, the feeding velocity $V_3$ of the image receptor is 1 to 10 times the peripheral velocity $V_2$, and the velocity $V_3$ is twice or more times the velocity $V_1$. That is, $1 < N_1 \leqq 10$, $1 < N_2 \leqq 10$, and $N_3 \geqq 2$. In this embodiment, a preferable relation is $N_1 = 1.4$ to 10, $N_2 = 1.4$ to 10, and $N_3 = 2$ to 10.

In any of Embodiments 1 to 3, preferably the velocity $N_3$ satisfies $N_3 \geqq 5$, from the viewpoint of reducing the amount of ink sheet to be consumed as small as possible.

Figure 4:
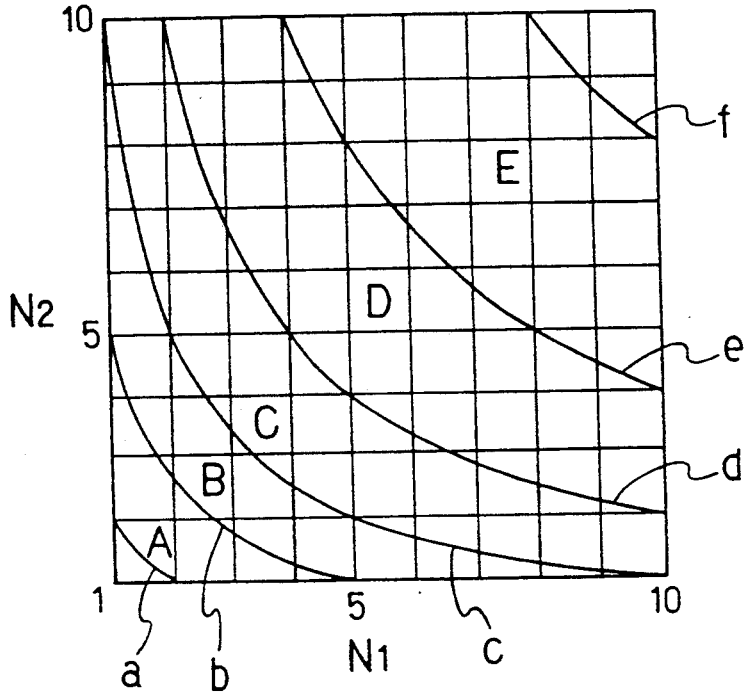
FIG. 4 is a graph showing the relation among $N_1$, $N_2$ and $N_3$ in the method according to the present invention.

FIG. 4 shows the relation among $N_1$, $N_2$ and $N_3$ and wherein A, B, C, D and E respectively indicate the following ranges of the velocity ratio $N_3$:

A . . . $2 \geqq N_3 \geqq 5$
B . . . $5 < N_3 \geqq 10$
C . . . $10 < N_3 \geqq 20$
D . . . $20 < N_3 \geqq 40$
E . . . $40 < N_3 \geqq 80$.

Figure 1:
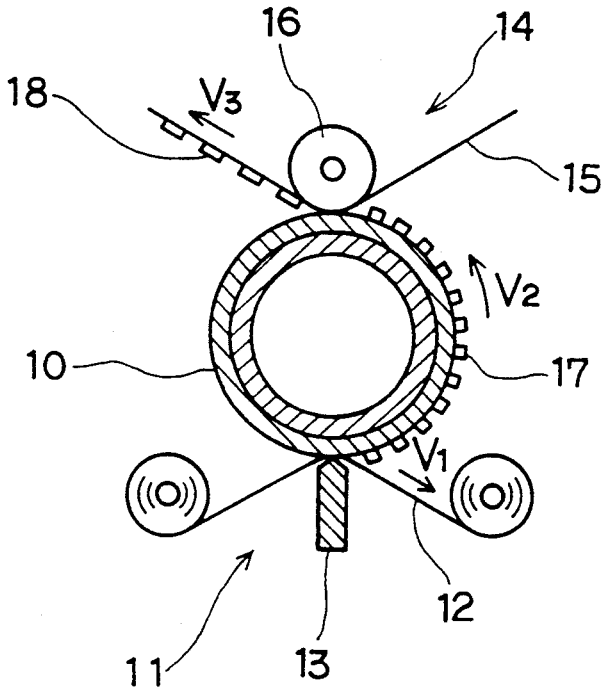
FIG. 1 is a a schematic explanatory view showing an indirect thermal transfer printing device as used in the present invention.

In the indirect thermal transfer printing method according to the present invention, an indirect thermal transfer printing device of the conventional type shown in FIG. 1 can be used as it is except that adjusted as above are the ratio $N_1$ of the peripheral velocity $V_2$ of the intermediate transfer drum 10 to the feeding velocity $V_1$ of the ink sheet, and the ratio $N_2$ of the feeding velocity $V_3$ of the image receptor 15 to the peripheral velocity $V_2$. Usually, the feeding velocity $V_1$ of the ink sheet 12 is selected from the range of 2 to 20 cm/second, the peripheral velocity $V_2$ of the intermediate transfer drum from the range of 2 to 20 cm/second, and the feeding velocity $V_3$ of the image receptor 15 from the range of 4 to 100 cm/second.

The intermediate transfer drum 10 is preferably heated at 60° to 80° C. so as to enhance the releasability of ink image 17 from the drum 10 onto the image receptor 15. It should be noted that instead of heating the intermediate transfer drum, the ink image on the drum can be heated with a heating roller or the like in the transfer part so as to be transferred onto the image receptor.

The surface tension of the drum (relative to air) is preferably 35 dynes/cm or less, particularly 25 dynes/cm or less in order to enhance the releasability of the ink image from the transfer drum and to prevent the surface of the drum from staining. However, the drum of too small surface tension degrades the adhesiveness of ink of the ink sheet to the drum and, hence, the surface tension thereof is preferably 20 dynes or more. The surface of the drum having such a surface tension is favorably formed of a silicone group-containing resin, a silicone group-containing rubber, a fluorine-containing resin, a fluorine-containing rubber or the like. However, usable therefore is any resin having a surface tension of the aforesaid degree while possessing elasticity, heat-resistance, chemical-resistance and the like to a satisfactory extent.

As the meltable-type thermal transfer ink sheet used in the present invention, any of conventional ones is usable. An example of such an ink sheet is that wherein on a foundation is provided a thermal transfer ink layer composed of a vehicle mainly comprising a heat-meltable material, and a coloring agent. As the heat-meltable material, heat-meltable resins and/or wax substances are used.

Examples of specific heat-meltable resins include ethylene copolymers such as ethylene-vinyl acetate copolymer, ethylene-vinyl butyrate copolymer, ethylene-(meth)acrylic acid copolymer, ethylene-alkyl (meth)acrylate copolymer wherein examples of the alkyl group are those having 1 to 16 carbon atoms, such as methyl, ethyl, propyl, butyl, hexyl, heptyl, octyl, 2-ethylhexyl, nonyl, dodecyl and hexadecyl, ethyleneacrylonitrile copolymer, ethylene-acrylamide copolymer, ethylene-N-methylolacrylamide copolymer and ethylenestyrene copolymer; poly(meth)acrylic acid esters such as polylauryl methacrylate and polyhexyl acrylate; vinyl chloride polymers and copolymers such as polyvinyl chloride, vinyl chloride-vinyl acetate copolymer and vinyl chloride-vinyl alcohol copolymer; polyesters such as sebacic acid-decanediol polymer, azelaic acid-dodecanediol polymer and azelaic acid-hexadecanediol polymer. These resins may be used either alone or in combination. From the viewpoint of thermal transfer sensitivity, preferable are those having a melting or softening temperature of 40° to 140° C. (value measured with DSC, hereinafter the same).

Examples of specific wax substances include natural waxes such as haze wax, bees wax, carnauba wax, candelilla wax, montan wax and ceresine wax; petroleum waxes such as paraffin wax and microcrystalline wax; synthetic waxes such as oxidized wax, ester wax, low molecular weight polyethylene and Fischer-Tropsch wax; higher fatty acids such as myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as stearic acid amide and oleic acid amide. These wax substances may be used either alone or in combination. From the viewpoint of thermal transfer sensitivity, preferable are those having a melting point of 40° to 120° C.

According to the present invention, a small amount of a liquid substance may be added to the aforesaid heat-meltable material for enhancing the transfer sensitivity thereof. Examples of such a liquid substance include natural oils and derivatives thereof such as rapeseed oil, caster oil, coconut oil, sunflower oil, corn oil, Meadow foam oil, linseed oil, safflower oil, lanolin and its derivatives, fish oils, squalane and jojoba oil, mink oil and horse oil; petroleum oils such as liquid paraffin, petrolatum, spindle oil and motor oil; surface active agents such as sorbitan oleate, polyoxyethylene fatty acid esters, polyoxyethylene alkylphenyl ethers and polyoxyethylene alkyl ethers; plasticizers such as dioctyl phthalate, tributyl acetylcitrate, dioctyl azelate, dioctyl sebacate, diethyl phthalate and dibutyl phthalate; and fatty acids such as oleic acid, lauric acid, linolic acid, linoleic acid and isostearic acid. These liquid substances may be used either alone or in combination.

As the coloring agent used in the aforesaid ink layer of a monochromatic thermal transfer ink sheet, usable are those used in a conventional thermal transfer ink sheet of this type, for example, carbon black and various organic and inorganic pigments having a great hiding power and dyes.

In the case where color images are formed by superimposing of an yellow ink, magenta ink and cyan ink, coloring agents for yellow, magenta and cyan are used in yellow, magenta and cyan ink layers, respectively. These coloring agents for yellow, magenta and cyan are preferably transparent.

Examples of specific transparent coloring agents for yellow include organic pigments such as Naphthol Yellow S, Hansa Tellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine Yellow GR, Permanent Yellow NCG and Quinoline Yellow Lake; and dyes such as Auramine. These coloring agents may be used either alone or in combination.

Examples of specific transparent coloring agents for magenta include organic pigments such as Permanent Red 4R, Brillant Fast Scarlet, Brilliant BS, Permanent Carmine FB, Lithol Red, Permanent Red F5R, Brilliant Carmine 6B, Pigment Scarlet 3B, Rhodamine Lake B, Rhodamine Lake Y and Arizalin Lake; and dyes such as Rhodamine. These colorants may be used either alone or in combination.

Examples of specific transparent coloring agents for cyan include organic pigments such as Victoria Blue Lake, metal-free Phthalocyanine Blue, Phthalocyanine Blue and Fast Sky Blue; and dyes such as such as Victoria Blue. These coloring agents may be used either alone or in combination.

The term "transparent pigment" is herein meant by a pigment which gives a transparent ink when dispersed in a transparent vehicle.

If the superimposing of the three colors, yellow, magenta and cyan, can hardly give a clear black color, there may be provided a black color ink layer containing a coloring agent for black such as carbon black, Nigrosine Base or the like. The black color ink layer for this purpose is not adapted for the superimposing with other color ink layer and, hence, need not be necessarily transparent. Nevertheless, the black color ink layer is preferably transparent for the purpose of giving a desired color such as blue black by the superimposing with other color ink layer.

The amount of each coloring agent to be used depends on the kind thereof but is, in general, preferably 5 to 40% by weight relative to the total amount of the solid contents of the ink layer for each color.

In the present invention, the ink layer may be incorporated, in addition to the above ingredients, with a dispersant for promoting the dispersing of the pigment, a filler such as doatomaceous earth, talc, silica powder and calcium carbonate, and other additives, as required.

The ink layer according to the present invention preferably has a melting or softening point higher than the temperature at which the intermediate transfer drum 10 is heated.

The ink layer can be formed by applying onto a foundation, with an appropriate applying means, a coating liquid prepared by dissolving or dispersing the aforesaid ingredients in an appropriate organic solvent or a coating liquid in the form of an aqueous dispersion or an emulsion, followed by drying. Examples of the appropriate applying means are roll coater, gravure coater, reverse coater and bar coater. The ink layer may be formed by hot melt coating. The amount of the ink layer after dried depends on the ratio $N_3$, but is, in general, preferably about 2 to about 15 $g/m^2$ for assuring a desired density of images.

As the aforesaid foundation, usable are polyester films, polyamide films, polyimide films, polycarbonate films, polyether sulfone films, polysulfone films, polyether imide films, polyether ether ketone films, and other various plastic films generally used as foundation films for ink sheets of this type. When such plastic films are used, it is desired to prevent the ink sheet from sticking to a thermal head by providing on the back side (the side in slide contact with the thermal head) of the foundation a conventionally known stick-preventing layer composed of a silicone resin, fluorine-containing resin, nitrocellulose resin, any of various lubricative heat-resistant resins modified with them, or any of the foregoing heat-resistant resins admixed with a lubricant. The foundation and/or the stick-preventing layer may contain an antistatic agent. Further, the foundation may be a thin sheet of paper having a high density such as condenser paper. The thickness of the foundation is preferably about 1 to about 9 μm, especially about 2 to about 4.5 μm for assuring good heat conduction.

In the present invention, either a continuous monochromatic ink layer may be provided on a single foundation, or a plurality of ink layers for different colors may be provided on a single foundation. As the ink sheet for color image formation, usually used is that wherein ink layers for yellow, magenta and cyan, and optionally for black, are provided repeatedly in the longitudinal direction thereof. However, such ink layers may be formed on separate foundations, respectively.

Figure 5:
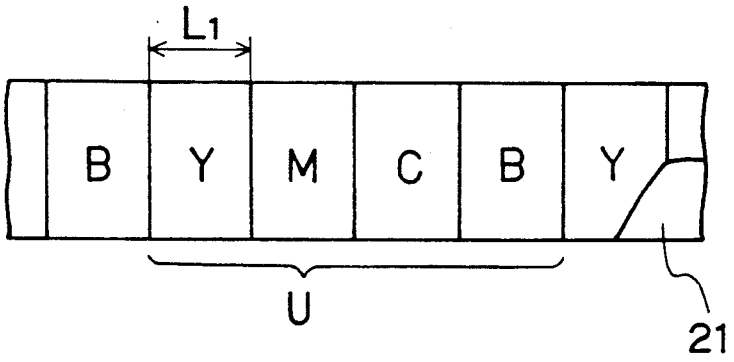
FIG. 5 is a plan view showing an arrangement of ink layers for individual colors in a thermal transfer ink sheet for color image formation as used in the present invention.

FIG. 5 is a plan view showing an example of the thermal transfer ink sheet wherein ink layers for yellow, magenta, cyan and black are arranged on a single, strip-like foundation. In FIG. 5 there are arranged on a strip-like foundation 21 an yellow ink layer Y, magenta ink layer M, cyan ink layer C and black ink layer B in a side-by-side relationship in the longitudinal direction of the foundation 21, which layers Y, M, C and B are repeatedly disposed in units of U. The order of arrangement of these four color ink layers can be selected as desired. The color ink layers may be disposed in a mutual abutment relation or mutually spaced apart relation, or in a mutually slightly overlapped relation within a range such as not to cause hindrance in practical use. Further, there may be provided a margin in one end or either end portion along the longitudinal direction of the foundation 21 and a marker for controlling the feed of the ink sheet in the margin.

Color image formation with use of the above thermal transfer ink sheet is achieved by selectively transferring the yellow ink layer Y, the magenta ink layer M, the cyan ink layer C or the black ink layer B onto the intermediate transfer drum to form a separation image in yellow, a separation image in magenta, a separation image in cyan or a separation image in black, respectively, thereby superimposing two or more separation images in respective colors one on the other on the drum. In this color image formation, intermediate colors other than yellow, magenta, cyan and black are obtained by subtractive color mixture wherein two or more kinds of ink dots in yellow, magenta and cyan are superimposed one on the other. It should be noted that the order of superimposing of the above separation images in respective colors one on the other can be selected as desired. Subsequently, the superimposed image on the intermediate transfer drum is transferred onto the image receptor.

When color images are formed in the manner described above, $L_1 \times N_1$ is adjusted to be substantially equal to $L_2$, where $L_1$ represents the length of each ink layer in the longitudinal direction of the foundation, and $L_2$ the length of the outer circumference of the intermediate drum. If the image receptor is composed of separate recording paper sheets, $L_2 \times N_2$ is adjusted to be substantially equal to the length (or width) of such a recording paper sheet.

With the indirect thermal transfer printing method according to the present invention, satisfactory ink images can be formed on a sheet of rough-surface paper having a Bekk smoothness of 20 seconds or less, or on cloth or the like. As a matter of course, satisfactory ink images can also be formed on a sheet of smooth-surface paper or a plastic film.

The present invention will be more fully described by way of experimental examples. It is to be understood that the present invention is not limited to the Examples, and various change and modifications may be made in the invention without departing from the spirit and scope thereof.

EXPERIMENTAL EXAMPLE 1

Onto one side of a 4.5 μm-thick, 297 mm-wide polyethylene terephthalate film provided on the other side thereof with a stick-preventing layer composed of a silicone-modified urethane resin in a dry coating amount of 0.1 g/m² was applied a coating liquid prepared by dissolving and dispersing in a toluene-ethyl acetate mixed solvent an ink composition shown in Table 1, followed by drying to give a thermal transfer ink sheet with a thermally-transferable ink layer having physical property values shown in Table 1.

TABLE 1

| Ingredient | % by weight |
|---|---|
| Ethylene-vinyl acetate copolymer (melt index: 400) | 30 |
| Paraffin wax (mp.: 75° C.) | 40 |
| Lanolin | 9 |
| Homogenol (dispersant produced by Kao Corporation) | 1 |
| Carbon black | 20 |
| Physical property value | |
| Softening point by DSC (°C.) | 72.3 |
| Coating amount (g/m²) | 3, 5, 12 |

With use of the thus obtained thermal transfer ink sheet, a printing test was conducted with the indirect thermal transfer device shown in FIG. 1 under conditions shown in Table 2 to determine the resolution (lines/mm) and the density (OD value) of a printed image. As the transfer drum, used was one coated at its surface with a silicone rubber (surface tension: 21 dynes/cm). The drum was heated at 70° C. As the image receptor, used was a plain paper sheet (Bekk smoothness: 36 seconds). The results are shown in Table 2.

TABLE 2

| Run No. | 1 | 2 | 3 | 4 | 5 | 6 |
|---|---|---|---|---|---|---|
| Transfer condition | | | | | | |
| Feeding velocity of ink sheet (cm/sec) | 3 | 3 | 3 | 3 | 3 | 3 |
| Peripheral velocity of intermediate transfer drum (cm/sec) | 3 | 9 | 3 | 9 | 15 | 15 |
| Feeding velocity of image receptor (cm/sec) | 9 | 9 | 18 | 18 | 45 | 75 |
| $N_3$ range | A | A | B | B | C | D |
| $N_3$ | 3 | 3 | 6 | 6 | 15 | 25 |
| $N_1$ | 1 | 3 | 1 | 3 | 5 | 5 |
| $N_2$ | 3 | 1 | 6 | 2 | 3 | 5 |
| Evaluated value | | | | | | |
| Resolution (lines/mm) | 7 | 7 | 4 | 5 | 3 | 2 |
| 3g/m² OD value | 1.1 | 1.1 | 1.0 | 1.0 | 0.9 | 0.7 |
| Resolution (lines/mm) | 7 | 7 | 4 | 5 | 3 | 2 |
| 5g/m² OD value | 1.3 | 1.3 | 1.1 | 1.1 | 1.0 | 0.8 |
| Resolution (lines/mm) | 7 | 7 | 4 | 5 | 3 | 2 |
| 12g/m² OD value | 1.6 | 1.6 | 1.5 | 1.5 | 1.2 | 1.0 |

EXPERIMENTAL EXAMPLE 2

On one side of a foundation identical with the foundation used in Experimental Example 1, color ink layers for yellow, magenta, cyan and black were formed by repeatedly applying each of coating liquids for yellow, magenta, cyan and black prepared by dissolving and dispersing in a benzene-ethyl acetate mixed solvent each of the compositions shown in Table 3 so as to have each color ink layer of A4 size. The arrangement of color ink layers was as shown in FIG. 5. As a result, an ink sheet for color image formation was obtained with the color ink layers for respective colors having physical property values shown in Table 3.

TABLE 3

| Ingredient | % by weight | | | |
|---|---|---|---|---|
| | Yellow | Magenta | Cyan | Black |
| Ethylene-vinyl acetate copolymer (melt index: 400) | 30 | 30 | 30 | 30 |
| Paraffin wax (mp.: 75° C.) | 40 | 40 | 40 | 40 |
| Lanolin | 9 | 9 | 9 | 9 |
| Homogenol (dispersant produced by Kao Corporation) | 1 | 1 | 1 | 1 |
| Carbon black | | | | 20 |
| Benzidine Yellow G | 20 | | | |
| Rhodamine Lake Y | | 20 | | |
| Phthalocyanine Blue | | | 20 | |
| Physical property value | | | | |
| Softening point by to DSC (°C.) | 72.7 | 72.1 | 72.0 | 72.3 |
| Coating amount (g/m$^2$) | 3 | 3 | 3 | 3 |

With use of the ink sheet thus obtained, a printing test was conducted to determine the resolution (lines/mm), density (OD value) and evaluate color reproducibility of a printed image, in the same manner as in Experimental Example 1 with the exception that images in yellow, cyan, magenta and black were sequentially superimposed one on the other on the transfer drum, and the superimposed image on the transfer drum was transferred onto the image receptor. The results are shown in Table 4. The values shown in Table 4 held true for the yellow-magenta superimposed portion, yellow-cyan superimposed portion, magenta-cyan superimposed portion and portion in black only.

TABLE 4

| Run No. | 1 | 2 |
|---|---|---|
| Transfer condition | | |
| Feeding velocity of ink sheet (cm/sec) | 3 | 3 |
| Peripheral velocity of intermediate transfer drum (cm/sec) | 3 | 3 |
| Feeding velocity of image receptor (cm/sec) | 9 | 18 |
| $N_3$ range | A | B |
| $N_3$ | 3 | 6 |
| $N_1$ | 1 | 1 |
| $N_2$ | 3 | 6 |
| Evaluated value | | |
| Resolution (lines/mm) | 7 | 4 |
| OD value | 1.6 | 1.5 |
| Color reproducibility | good | good |

It should be noted that in Experimental Example 2 was conducted an additional experiment for obtaining black color by superimposing ink layers for yellow, magenta and cyan without using the black ink layer. This experiment revealed that a good color reproducibility was achieved for colors other than black color although the obtained black color slightly deviated from real black.

As has been described, according to the present invention the amount of ink sheet to be consumed can be substantially reduced while at the same time the printing speed can be increased. In addition, the present invention contributes to a scaling-down of a thermal transfer printing device. Of course, clear images can be obtained regardless of the type of an image receptor.

In addition to the materials and ingredients used in the Examples, other materials and ingredients can be used in the Examples as set forth in the specification to obtain substantially the same results.

What is claimed is:

1. A thermal transfer printing method comprising the steps of: forming first an image on an intermediate transfer drum by heating a meltable-type thermal transfer ink sheet with a thermal head; and transferring the image formed on the intermediate transfer drum onto an image receptor, wherein the meltable-type thermal transfer ink sheet and the image receptor are fed at a velocity $V_1$ and a velocity $V_3$, respectively and the intermediate transfer drum rotates at a peripheral velocity $V_2$ the velocities $V_1$, $V_2$ and $V_3$ satisfying the equations (1), (2) and (3):

$$N_1 = V_2/V_1 = 1 \text{ to } 10 \quad (1)$$

$$N_2 = V_3/V_2 = 1 \text{ to } 10 \quad (2)$$

$$N_3 = V_3/V_1 \geqq 2 \quad (3).$$

2. The method of claim 1, wherein $N_1=2$ to 10, $N_2=1$, and $N_3=2$ to 10.

3. The method of claim 2, wherein $10 \geqq N_3 \geqq 5$.

4. The method of claim 1, wherein $N_1=1$, $N_2=2$ to 10, and $N_3=2$ to 10.

5. The method of claim 4, wherein $10 \geqq N_3 \geqq 5$.

6. The method of claim 1, wherein $1 < N_1 \leqq 10$, $1 < N_2 \leqq 10$, and $N_3 \geqq 2$.

7. The method of claim 6, wherein $10 \geqq N_3 \geqq 5$.

8. The method of claim 1, wherein $10 \geqq N_3 \geqq 5$.

9. The method of claim 1, wherein a color image is formed using as said meltable-type thermal transfer ink sheet an ink sheet comprising on a strip foundation a yellow ink layer, a magenta ink layer and a cyan ink layer which are repeatedly arranged in a side-by-side relationship in the longitudinal direction of the foundation and superimposing at least two of a yellow image, a magenta image and a cyan image one on the other, while satisfying the equation:

$$L_1 \times N_1 = L_2$$

where $L_1$ represents the length of each of the ink layers in the longitudinal direction of the foundation, and $L_2$ represents the length of the outer circumference of the intermediate transfer drum.

10. The method of claim 9, wherein said meltable-type thermal transfer ink sheet further includes a black ink layer in addition to the yellow ink layer, the magenta ink layer and cyan ink layer.

* * * * *